US005746331A

United States Patent [19]

Kurtis

[11] Patent Number: 5,746,331

[45] Date of Patent: May 5, 1998

[54] COLLAPSIBLE STAND FOR SCHOOL LOCKER

[76] Inventor: Rachel M. Kurtis, 6704 Cedar View Ct., Clifton, Va. 20124

[21] Appl. No.: 783,516

[22] Filed: Jan. 14, 1997

[51] Int. Cl.[6] ..... A47F 5/10

[52] U.S. Cl. ..... 211/149; 211/150; 211/195; 211/201

[58] Field of Search ..... 211/149, 150, 211/195, 201; 108/115; 312/311, 331, 293.1, 293.2

[56] References Cited

U.S. PATENT DOCUMENTS

| | | | |
|---|---|---|---|
| 1,549,146 | 8/1925 | Miner | 211/195 |
| 3,322,077 | 5/1967 | Kovacik | 108/115 |
| 3,630,387 | 12/1971 | Wehner | 211/195 |
| 4,283,099 | 8/1981 | Burton | 312/351 |

FOREIGN PATENT DOCUMENTS

| | | | |
|---|---|---|---|
| 203388 | 6/1939 | Switzerland | 211/149 |

*Primary Examiner*—Peter R. Brown
*Assistant Examiner*—Anthony D. Barfield
*Attorney, Agent, or Firm*—Earl Levy

[57] ABSTRACT

A collapsible stand, having a number of shelves, which can be placed on the floor of a school locker to store and arrange small articles thereon in a convenient manner, and wherein the stand is self-locking and requires no manually manipulated braces for maintaining it in an operational position.

4 Claims, 3 Drawing Sheets

24
23
10
21
24
24
27
22
29
28
26
29
25
24

24
10
23
21
24
22
27
28
29
24

COLLAPSIBLE STAND FOR SCHOOL LOCKER

BACKGROUND OF THE INVENTION

This invention relates to a collapsible stand which can be positioned in the bottom of a school locker as a convenience to store small articles such as shoes and books. Lockers in schools and colleges are provided for the convenience of the students so they may have a private and secure place to store their possessions while attending classes and school functions.

A typical school locker consists of an upright steel cabinet having a single hinged door which can be swung open from a locked position to a fully open position exposing the interior storage space. A shelf is provided in the upper portion along with attachments to hang coats and garments. The bottom floor of the locker is usually piled high with books, school supplies, clothing, and other items, hurriedly tossed there by students on their way to and from classes.

There is a need for a stand to be placed on the floor of a locker to store the piled items in an orderly fashion, and to maximize the utility of the available space. On the other hand, occasions may arise when the bottom of the locker must be cleared to accommodate a bulky item such as a briefcase. In these situations, the stand must be removed and collapsed in a tight configuration so as to be capable of being stored against a sidewall of the locker while occupying minimal space.

A number of collapsible storage stands of a general nature as well as storage attachments for school lockers have been invented as typified by U.S. Pat. No. 1,895,535, issued Jan. 31, 1933 to G. F. Brecht; U.S. Pat. No. 3,182,809, issued May. 11, 1965 to E. N. Getoor; and U.S. Pat. No. 4,779,742, issued Oct. 25, 1988 to K. T. Starkweather et al. The patent to Brecht shows a collapsible stand with a plurality of shelves maintained in an upright position by a number of locking braces. Getoor and Starkweather et al. show a locker with internally mounted carriers to support small articles.

While the above mentioned patents do teach collapsible stands and article carriers installed in lockers, the prior art does not teach a collapsible stand, in its opened condition, not requiring any extraneous locking structure, and, moreover, does not teach the combination of such a stand with a locker.

SUMMARY OF THE INVENTION

The overall object of the present invention is to provide a school locker with a collapsible stand supported by the floor and back wall to conveniently store a number of small items.

It is a specific object of the invention to provide a collapsible stand with several shelves for a locker which can be easily set up and collapsed without the need for any extraneous braces or manipulated latches.

It is another object of the invention to design the stand to occupy minimal space in the collapsed position so that it may be readily stored against a side wall of the locker.

It is yet another object of the invention to design the collapsible stand with a minimum number of parts so as to be durable, reasonably priced, and easily carried and manipulated by students.

DESCRIPTION OF THE PREFERRED EMBODIMENT

Figure 1:
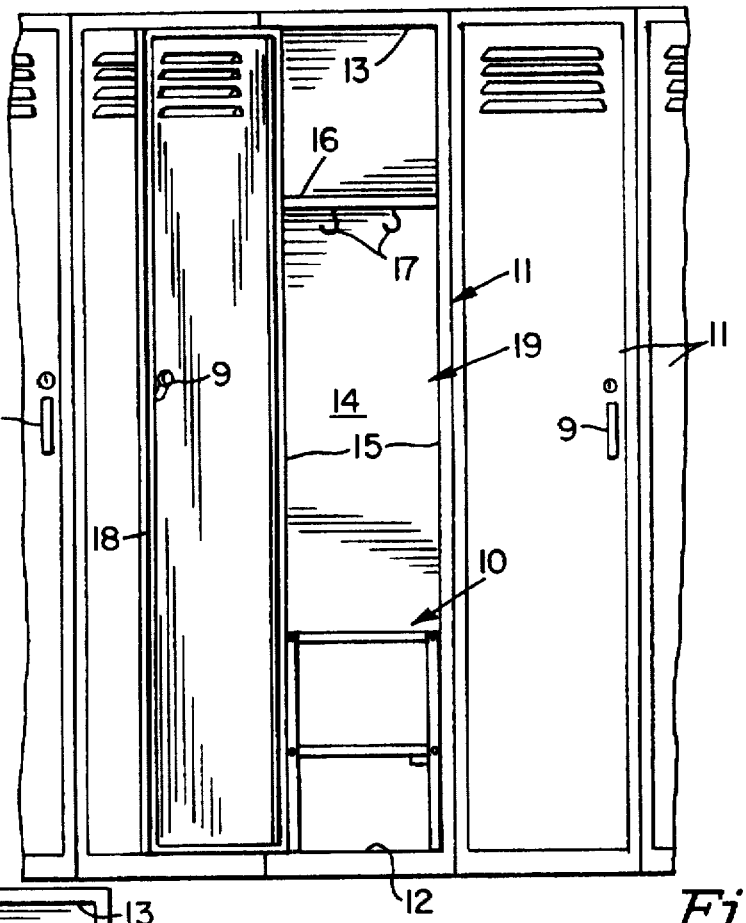
FIG. 1 is a front view of a locker with the stand of the invention mounted therein.
Figure 2:
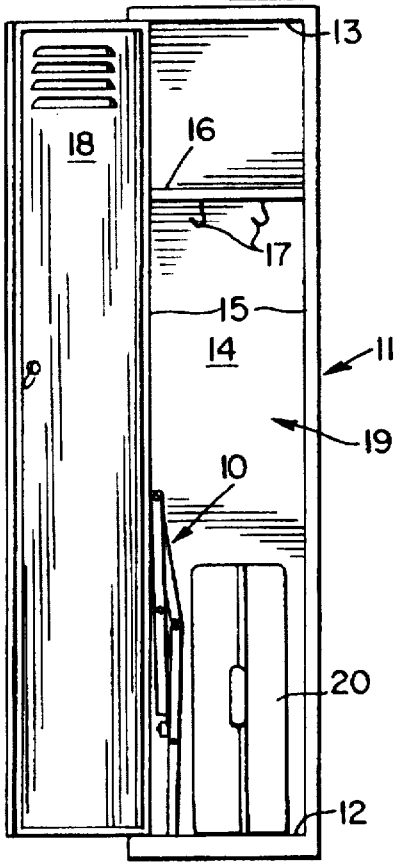
FIG. 2 is a front view of the locker of FIG. 1 with the stand in a collapsed position and stowed against a side wall.

Referring now in general to the drawings and in particular to FIGS. 1 and 2, the novel stand 10 of this invention is shown in FIG. 1 mounted in its operational position in a typical school locker 11. School lockers are generally arranged in a side-by-side relationship. The locker 11 includes a bottom floor 12, a top ceiling 13, a back wall 14, two side walls 15, an upper shelf 16, garment supports 17, a door 18 (which can close the locker opening 19 to secure the contents of the locker), and door handle 9. The locker itself is conventional but is part of the invention because of its combinational relationship with the stand.

The stand 10, which will be described in detail in connection with FIGS. 3–7, is shown in FIG. 1 seated on floor 12 with its rear portion against back wall 14. In this position the stand can hold a variety of small articles while leaving clearance for hanging garments or sports items.

FIG. 2 is a view similar to FIG. 1 but showing the stand 10 in a collapsed position and stowed against a side wall 15 to allow room for a bulky item such as a briefcase 20 to be placed in the locker.

Referring now to FIGS. 3–7, the collapsible stand of this invention is formed of two back vertical legs 21 and two front vertical legs 22. The term back vertical legs derives from the fact that, when the stand is placed in its operative postion on the floor of the locker, the back legs 21 abut the back wall 14 of the locker and are supported thereby. The term front vertical legs derives from the fact that front legs 21 are located at the front of locker opening 19.

Figure 4:
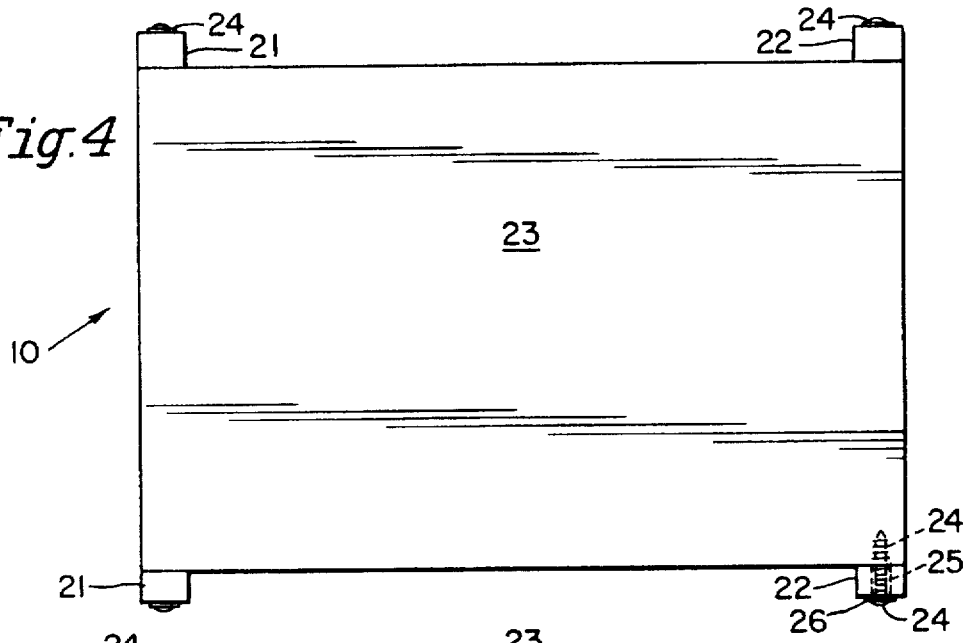
FIG. 4 is a top view of FIG. 3.

A top shelf 23 is pivotally mounted to each vertical leg to lie substantially flush with the upper ends of the legs. As shown in FIG. 4, each pivotal mounting comprises a wood screw 24 passing through an oversized hole 25 drilled through the vertical leg and screwed into a side portion of shelf 23. The wood screw 24 has a flat head 26 which drives the screw into shelf 23 until head 26 lightly engages the outer surface of the vertical leg. In this manner, the shelf will be secured to the vertical leg while permitting pivotal movement of the shelf with respect to the leg.

While only one pivotal connection is described, all the pivotal connections used in this stand are similar. Also, it should be understood that pivotal connections other than screws, such as pivot pins driven into the shelf, can also be employed.

A lower shelf 27 is pivotally secured to the vertical legs in the same manner as top shelf 23. The lower shelf is secured to the legs so as to be at a distance above the locker floor 12 to provide a storage space below shelf 27 as well as above it.

Figure 3:
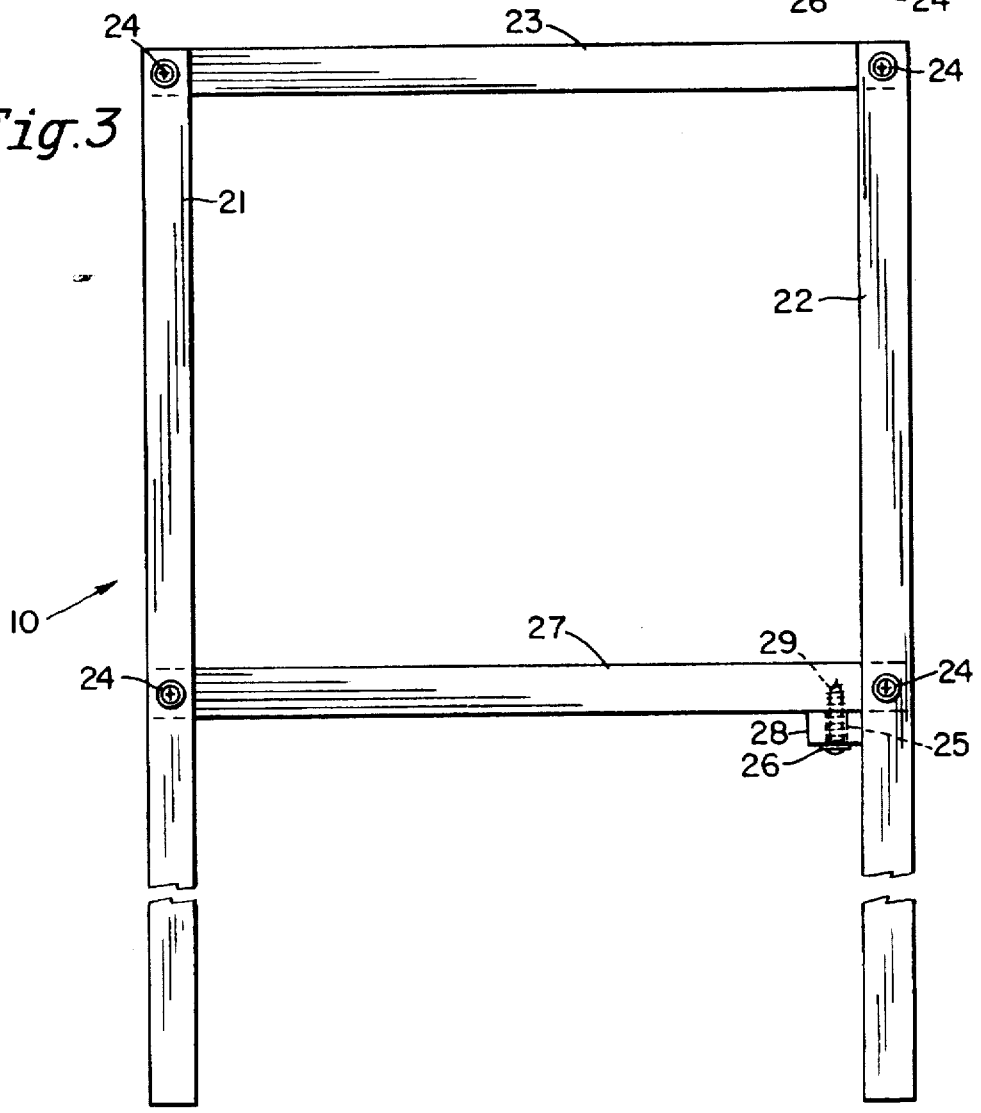
FIG. 3 is a side elevation view of the stand of the invention in its opened condition.

The stand, so far described, is unstable and can collapse by rotation to the left or right from the upright position as shown in FIG. 3. However, as previously mentioned, back legs 21 abut back wall 14 in its installed position which prevents the stand from collapsing in a movement to the left or in a counter clockwise direction.

Collapsing motion of the stand shown in FIG. 3 in a right or clockwise direction is prevented by means of a rigid stop bar 28 which is secured to the underside of lower shelf 27 by means of a plurality of screws such as shown at 29. The stop bar is secured to the underside of the lower shelf at a location to limit rotation of shelf 27 to a right angular position by having the stop bar abut the front legs 22.

From the above, it can be seen that stand 10, when placed in its operative position on the floor of a locker as shown in FIG. 1 will be held in a stable position by back legs 21 which are braced by the back wall 14 of the locker and by stop bar 28 which limits forward or clockwise rotation of the stand.

The ability of the disclosed stand to be self-locking is a very important aspect of the invention. By simply unfolding and placing it in the locker, the stand inherently assumes an operative position. The need for various braces, catches and other locking devices requiring manual attention is avoided. This not only reduces the cost of manufacturing but eliminates the need for students to figure out how to secure the braces and locking devices of the prior art stands.

Figure 5:
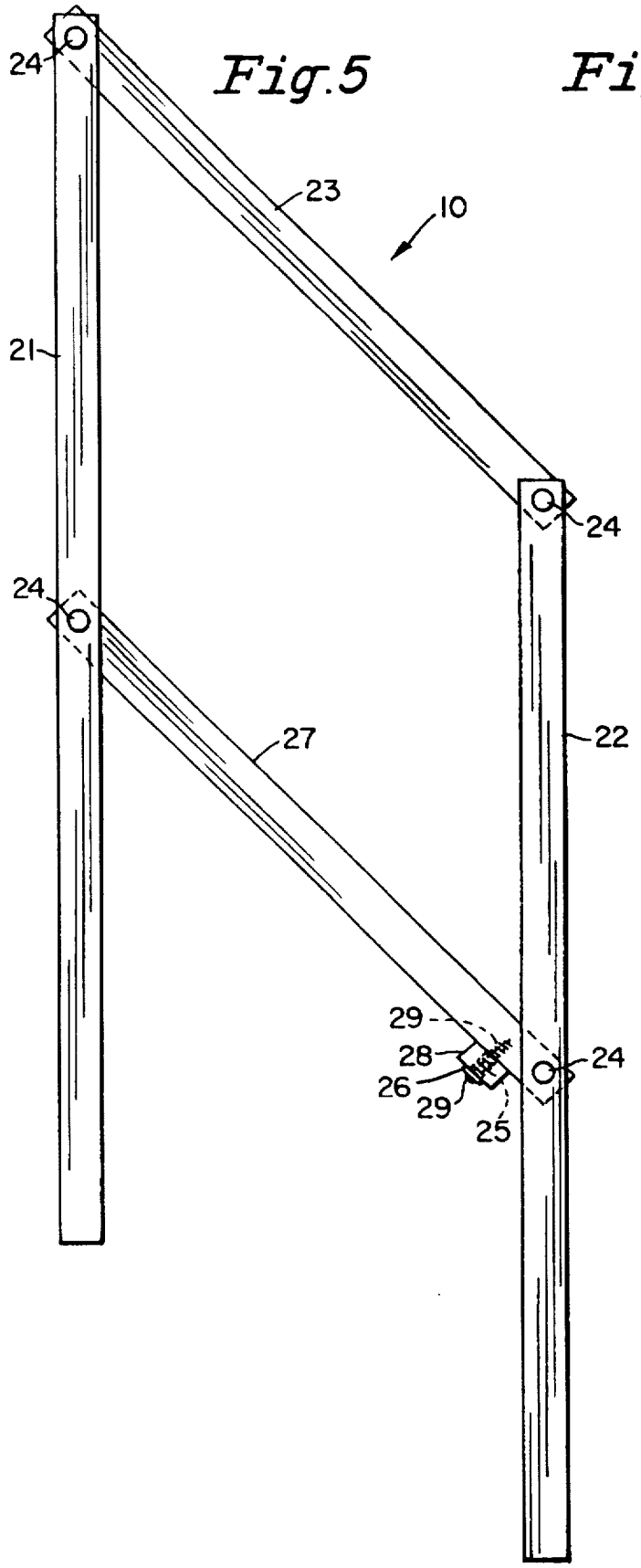
FIG. 5 is a side view of the stand shown in FIG. 3 in a partially collapsed position.
Figure 6:
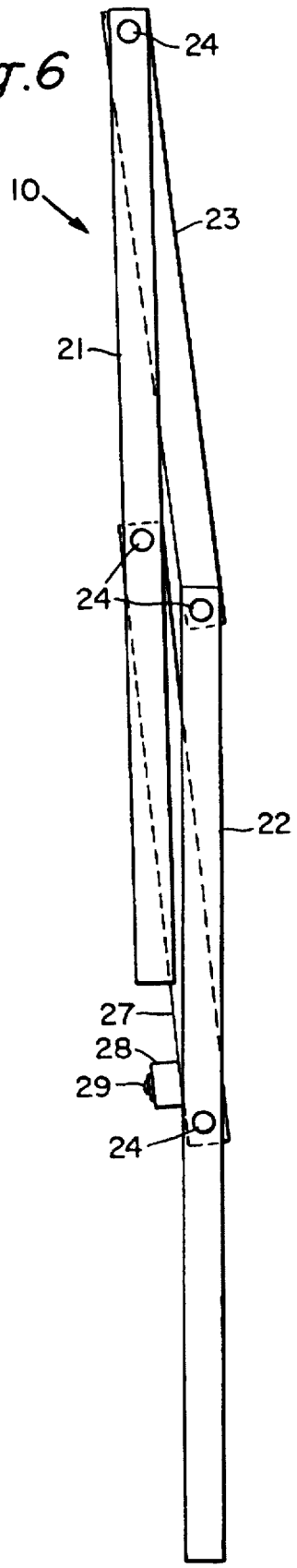
FIG. 6 is a side view of the stand shown in FIG. 4 in its fully collapsed position.

The manner of collapsing the stand for stowage purposes will now be explained in connection with FIGS. 5 and 6. After the stand has been removed from the locker and while still in the upright position, the back end of top shelf 23 is rotated around the pivots 24 in the front legs 22, raising back legs 21 with simultaneous rotation of lower shelf 27. Stop bar 28, carried by shelf 27, is rotated away from its stop position against front legs 22. The partially collapsed position is shown in FIG. 5.

Continued rotation of top shelf 23 around its pivots 24 will result in the shelves 23 and 27 being rotated in a clockwise collapsing direction with respect to the back and front legs. Continued rotation of shelf 23 in a clockwise direction results in a fully collapsed position as shown in FIG. 6. It should be noted that the design of the stand allows for a compact stowage position taking up minimum space when stowed against the side wall of the locker as shown in FIG. 2. The compact stowage position is enabled by placement of stop bar 28 on the bottom of shelf 27 where it can be rotated to an external exposed position as seen in FIG. 6. In contradistinction, the placement of stop bar 28 directly on front legs 22 would result in the stop bar preventing a fully collapsed position.

The stand is returned to its operational position by reversing the collapsing procedure. Top shelf 23 is rotated in a counter clockwise direction, moving back legs 21 downwardly and bottom shelf 27 to a stop position determined by engagement of stop bar 28 with front legs 22. The unfolded stand is then simply placed in the locker. Again, it should be noted that the stand is folded and unfolded without the need to manipulate any braces or locks.

Figure 7:
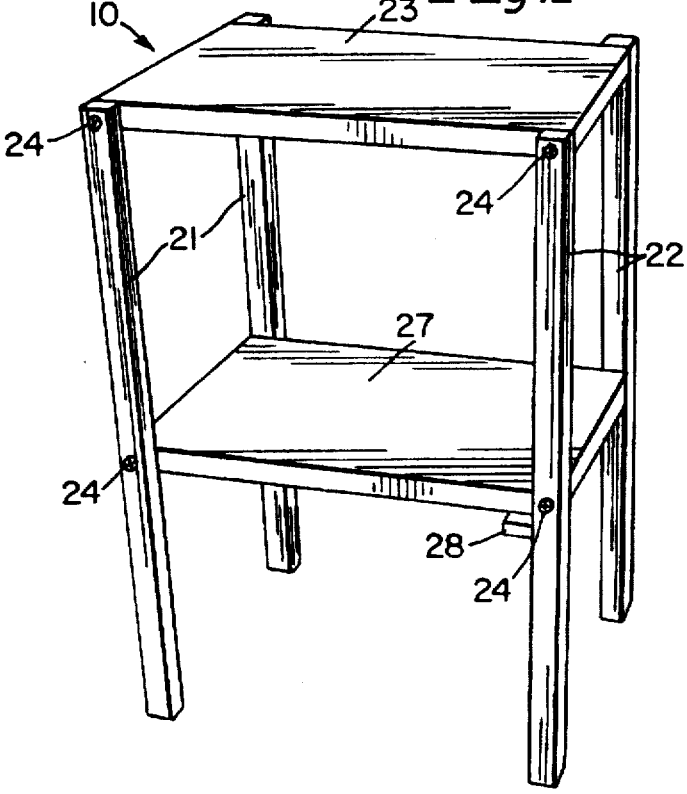
FIG. 7 is a perspective view of the stand in its erected position.

FIG. 7 is a perspective view showing the stand in its unfolded position with all of the parts shown in their spatial and functional relationships.

While the preferred embodiment employs wood construction, it is within the purview of the invention to manufacture the stand of sheet metal or plastic material. The pivotal connections would be appropriately selected of these alternative materials. Also, while the disclosed stand has been described in connection with a school locker, it should be understood that the stand can be used in commercial and institutional applications.

It is not intended to limit the present invention to the details of illustration or terms of description of the single preferred embodiment shown above. It will be appreciated by those skilled in the art that various modifications and alterations therein may be made within the scope of the present invention.

What is claimed is:

1. In combination with a school locker comprising an upright steel locker having a back wall joined by two side walls, a bottom floor and a top ceiling defining an open interior, a door hinged to one of said side walls for movement to an open position exposing the interior of the locker and to a closed position blocking access to the interior, the improvement comprising a collapsible stand removably inserted in said locker to be stored therein in a collapsed position and supported by said floor and one wall of said locker in an extended position, said stand formed of a pair of vertically spaced back legs, a pair of vertically spaced front legs, a top shelf and a lower shelf, said shelves pivotally connected to said back pair and said front pair of vertical legs for limited motion in a clockwise and counter clockwise direction, a horizontally displaced stop bar secured to a bottom portion of said lower shelf for limiting rotational movement of said lower shelf by abutting said pair of front vertical legs to maintain said lower shelf in a horizontal substantially extended position whereby, when said stand is placed in said locker against said one wall, it is supported on said floor and prevented from collapsing by said stop bar preventing lower shelf rotational movement in one direction and said one wall preventing rotational movement of said back legs in the same direction.

2. The combination of claim 1 wherein said top shelf is pivotally mounted on said back and front support legs to lie in a substantially flush position with the tops of said legs when said stand is unfolded into an operative position.

3. The combination of claim 2 wherein said stand can be removed from said locker and collapsed by rotating said top shelf in a clockwise direction to raise said back legs and rotate said lower shelf wherein said stand can be collapsed in a compact manner.

4. In combination with a school locker comprising an upright steel locker having a back wall joined by two side walls, a bottom floor and a top ceiling defining an open interior, a door hinged to one of said side walls for movement to an open position exposing the interior of the locker and to a closed position blocking access to the interior, the improvement comprising a collapsible stand removably inserted in said locker to be supported by said floor and back wall, said stand formed of a pair of vertically spaced back legs, a pair of vertically spaced front legs, a top shelf and a lower shelf, said shelves pivotally connected to said back pair and said front pair of vertical legs for limited motion in a clockwise and counter clockwise direction, a horizontally disposed stop bar secured to a bottom portion of said lower shelf for limiting counter clock vise rotation of said lower shelf by abutting said vertical legs to maintain said lower shelf in a substantially horizontal position whereby, when said stand is placed in said locker against said back wall, it is supported on said floor and prevented from collapsing by said stop bar preventing lower shelf movement in a counter clockwise direction and said locker rear wall preventing movement of said back legs in a counter clockwise direction, and wherein said stand is made of wood and said pivotal connections between said shelves and back and front legs comprise a wood screw with a flat head, said screw passing through an oversized hole in said leg and being screwed into a side portion of the respective shelf to a depth until the screw flat head lightly contacts the leg whereby the shelf is secured to said leg while permitting rotation therebetween.

* * * * *